US008811880B2

(12) United States Patent
Fujita

(10) Patent No.: US 8,811,880 B2
(45) Date of Patent: Aug. 19, 2014

(54) PROCESSING APPARATUS AND IMAGE FORMING SYSTEM

(75) Inventor: Takashi Fujita, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 280 days.

(21) Appl. No.: 13/439,122

(22) Filed: Apr. 4, 2012

(65) Prior Publication Data

US 2012/0269559 A1 Oct. 25, 2012

(30) Foreign Application Priority Data

Apr. 25, 2011 (JP) ..... 2011-097684

(51) Int. Cl.
*G03G 15/20* (2006.01)

(52) U.S. Cl.
USPC ..... 399/341; 399/342

(58) Field of Classification Search
USPC ..... 399/341, 342
See application file for complete search history.

(56) References Cited

U.S. PATENT DOCUMENTS

| | | | | |
|---|---|---|---|---|
| 5,234,783 | A * | 8/1993 | Ng | 430/45.53 |
| 7,024,149 | B2 | 4/2006 | Kito et al. | |
| 7,167,659 | B2 | 1/2007 | Fujita et al. | |
| 7,362,982 | B2 | 4/2008 | Fujita et al. | |
| 7,672,634 | B2 * | 3/2010 | Lofthus et al. | 399/341 |
| 7,738,805 | B2 * | 6/2010 | Lofthus et al. | 399/69 |
| 7,783,242 | B2 | 8/2010 | Chigono et al. | |
| 8,086,124 | B2 * | 12/2011 | Zaima | 399/53 |
| 8,139,995 | B1 | 3/2012 | Fujita et al. | |
| 8,649,721 | B2 * | 2/2014 | Kosasa | 399/341 |
| 2004/0096250 | A1 | 5/2004 | Kito et al. | |
| 2007/0147917 | A1 | 6/2007 | Chigono et al. | |
| 2012/0213565 | A1 * | 8/2012 | Furuyama | 399/341 |
| 2013/0070267 | A1 * | 3/2013 | Kosasa | 358/1.9 |

FOREIGN PATENT DOCUMENTS

| | | | |
|---|---|---|---|
| JP | 6-138805 | A | 5/1994 |
| JP | 2001-130150 | A | 5/2001 |
| JP | 2004-170548 | A | 6/2004 |
| JP | 2007-086747 | A | 4/2007 |

* cited by examiner

*Primary Examiner* — David Gray
*Assistant Examiner* — Geoffrey Evans
(74) *Attorney, Agent, or Firm* — Fitzpatrick, Cella, Harper & Scinto

(57) ABSTRACT

The processing apparatus includes: a first storage device that stores correction image information defining a correction image Ap formed on the surface of a to-be-processed medium S, in which the positional relationship relative to an output image formed on the surface of the to-be-processed medium S is known; a second storage device that stores processing area information defining an area of the surface of the to-be-processed medium S heated by a heating unit, in which the positional relationship with the output image formed on the surface of the to-be-processed medium S is known; and a control unit that uses a detection result of a correction image formed on the surface of the to-be-processed medium S detected by an image detection unit and the correction image information to correct a heating position on the surface of the to-be-processed medium S heated by the heating unit indicated by the processing area information.

7 Claims, 11 Drawing Sheets

PROCESSING APPARATUS AND IMAGE FORMING SYSTEM

BACKGROUND OF THE INVENTION

1. Field of the Invention

The present invention relates to a processing apparatus and an image forming system including the processing apparatus that executes a process of selectively heating different areas in a direction substantially orthogonal to a conveyance direction of a to-be-processed medium through a film.

2. Description of the Related Art

Conventionally, the gloss of the surface of most printed matter varies, depending on the coverage rate, because the glossiness of the recording material and the glossiness of color material are different. For such a printed matter, various methods are proposed to create a uniform glossy surface over the entire surface of the printed matter through various post-processes such as over-coating.

In recent years, a demand for a fully glossy image or a printed matter with a high added value of partial glossing is increasing in an electrophotographic system. Japanese Patent Application Laid-Open No. 2007-086747 proposes a method of improving the gloss of the entire surface of a printed matter and recording a photographic tone. In the method, the surface of the printed matter provided with an image by toners is reheated through an endless belt with a highly smooth surface to melt the toners again. The toners are then cooled while the toners are in touch with the belt, and the toners are solidified while the smoothness of the belt is transferred to the surface of the image formed by the toners. Although the gloss of the entire printed matter can be controlled in the method, the gloss of the surface of the printed matter cannot be partially controlled.

Meanwhile, Japanese Patent Application Laid-Open No. 2004-170548 discloses a method of using a thermal head to partially control the gloss of the surface of a printed matter. Specifically, a configuration is disclosed, in which the thermal head partially heats the surface of a sheet body, the sheet body is conveyed while a pressure roller presses the sheet body against an endless belt, and the sheet body is cooled while the sheet body is in close contact with the endless belt.

However, the sheet shrinks if the sheet is heated prior to a selective heating process of an arbitrary position. Therefore, if the shrinkage of the sheet is ignored to partially heat the sheet, there is a problem that the gloss of a section different from an intended section is changed.

SUMMARY OF THE INVENTION

An object of the present invention is to provide a processing apparatus that processes a sheet output from an image forming apparatus including an image forming device that forms an image on a sheet and a heating device that heats the sheet on which the image is formed, the processing apparatus including a conveyance device that conveys a sheet, a partial heating device that heats a part/parts of the sheet selectively, a position acquisition device that acquires a heat position at which the partial heating device heats the sheet, a detection device that detects the image on the sheet heated by the heating device, on an upstream side of the partial heating device, a distance acquisition device that acquires distance information in the image that is obtained before the heating device heats the sheet, the image being formed on the sheet by the image forming device, and a controller that corrects the heat position at which the partial heating device heats the sheet, acquired by the position acquisition device, based on a detection result of the detection device and the distance information acquired by the distance acquisition device.

Another object of the present invention is to provide an image forming system including an image forming device that forms an image on a sheet, a heating device that heats the sheet having the image formed by the image forming device, and a processing apparatus that processes a sheet output from an image forming apparatus including an image forming device that forms an image on a sheet and a heating device that heats the sheet on which the image is formed, the processing apparatus including a conveyance device that conveys a sheet, a partial heating device that heats a part/parts of the sheet selectively, a position acquisition device that acquires a heat position at which the partial heating device heats the sheet, a detection device that detects the image on the sheet heated by the heating device, on an upstream side of the partial heating device, a distance acquisition device that acquires distance information in the image that is obtained before the heating device heats the sheet, the image being formed on the sheet by the image forming device, and a controller that corrects the heat position at which the partial heating device heats the sheet, acquired by the position acquisition device, based on a detection result of the detection device and the distance information acquired by the distance acquisition device.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, a surface processing apparatus and an image forming system including the surface processing apparatus according to the present invention will be described in further detail with reference to the drawings.

First Embodiment

1. System Configuration

Figure 1:
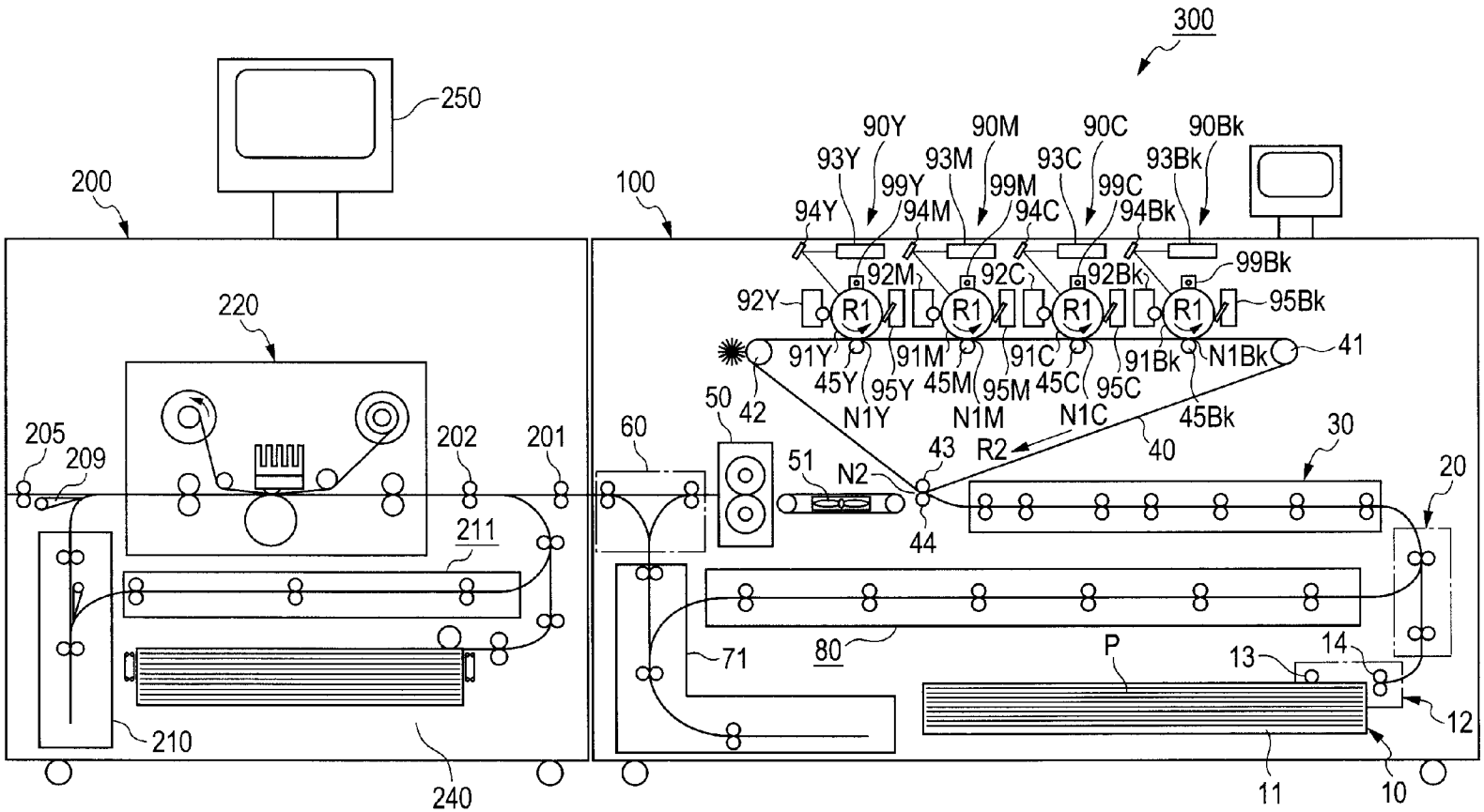
FIG. 1 is a schematic cross-sectional view of an image forming system including a surface processing apparatus according to an embodiment.

FIG. 1 is a schematic cross-sectional view illustrating an overall configuration of the image forming system including the surface processing apparatus according to an embodiment of the present invention. In the present embodiment, an image forming apparatus 100 of an electrophotographic system and a surface processing apparatus 200 are connected to form an image forming system 300. In the image forming system 300, the image forming apparatus 100 forms an image on a recording material P, such as recording paper, by thermofusible toners based on the electrophotographic system and transfers the image to the surface processing apparatus 200 connected on a downstream side thereof in a conveyance direction of the recording material P. The surface processing apparatus 200 handles the recording material P provided with the image as a to-be-processed medium S to execute a process of controlling the surface property of the surface (surface processing) and outputs the to-be-processed medium S. More specifically, the image forming apparatus 100 forms an image on the recording material P, such as recording paper, through image forming processes of developing, transferring, and fixing toner images. Meanwhile, the surface processing apparatus 200 handles the recording material P output from the image forming apparatus 100 as the to-be-processed medium S and executes a process of using a thermal head and a film to provide glossiness to the image on the to-be-processed medium S in the present embodiment (glossy processing).

In a configuration of heating the sheet by the thermal head through the film, the thermal head heats the sheet after the sheet and the film come in contact. Therefore, it is difficult to eliminate a skew generated when the sheet hits the film.

2. Image Forming Apparatus

The image forming apparatus 100 is a tandem digital printer adopting an intermediate transferring system that can form a full-color image using the electrophotographic system. The image forming apparatus 100 includes a plurality of image forming parts, which are first, second, third, and fourth image forming parts (stations) 90Y, 90M, 90C, and 90Bk that form images of Y (yellow), M (magenta), C (cyan), and Bk (black) colors, respectively.

Configurations and operations of the image forming parts 90Y, 90M, 90C, and 90Bk are substantially the same, except that the used colors of toners are different. Therefore, when distinction is not particularly necessary, suffixes Y, M, C, and Bk provided to reference numerals in the drawings to indicate elements of the colors are omitted, and the elements are commonly applied to each color and will be comprehensively described.

The image forming part 90 includes a drum-type electrophotographic photosensitive member (photosensitive member) 91 as an image carrier. The photosensitive member 91 rotates and is driven in an arrow R1 direction in FIG. 1. The following units are arranged in the direction of rotation around the photosensitive member 91. A charge device 99 serves as a charge unit. An exposure device (laser scanner device) 93 serves as an exposure unit. A developer 92 serves as a development unit. A primary transfer roller 45, which is a roller-type transfer member, serves as a primary transfer unit. A cleaner 95 serves as a photosensitive member cleaning unit.

Opposing the photosensitive members 91 of the image forming parts 90, an intermediate transferring member 40 in an endless belt shape is arranged as an intermediate transferring body. The intermediate transferring member 40 is stretched around a tension roller 41, a driving roller 42, and a secondary transfer inner roller 43 as a plurality of support members. As the driving roller 42 is rotated and driven, the intermediate transferring member 40 rotates in an arrow R2 direction in FIG. 1 (rolling movement). The primary transfer rollers 45 face the photosensitive members on the inner peripheral surface of the intermediate transferring member 40. The primary transfer rollers 45 are pressed against the photosensitive members 91 through the intermediate transferring member 40 to form primary transfer parts (primary transfer nips) N1 where the intermediate transferring member 40 and the photosensitive members 91 come in contact. A secondary transfer outer roller 44 that is a roller-type transfer member as a secondary transfer unit is arranged at a position opposing the secondary transfer inner roller 43 on the outer peripheral surface of the intermediate transferring member 40. The secondary transfer outer roller 44 is pressed against the secondary transfer inner roller 43 through the intermediate transferring member 40 to form a secondary transfer part (secondary transfer nip) N2 where the intermediate transferring member 40 and the secondary transfer outer roller 44 come in contact.

A fixation apparatus 50 as a fixation unit is arranged on the downstream side of the secondary transfer part N2 in the conveyance direction of the recording material P. The image forming apparatus 100 includes a paper feeding apparatus 10 arranged on the upstream side of the secondary transfer part N2 in the conveyance direction of the recording material P, a pre-fixation conveyance unit 51 arranged between the secondary transfer part N2 and the fixation apparatus 50, and a branch conveyance device 60 arranged on the downstream side of the fixation apparatus 50.

The recording material (sheet, recording medium) P is mounted on and stored in a lift-up apparatus 11 included in the paper feeding apparatus 10. A paper feeding unit 12 feeds the recording material P in accordance with image forming timing of the image forming part 90. A paper feeding roller 13 picks up the uppermost recording material P, and the paper feeding unit 12 feeds the recording material P, piece by piece. If a plurality of pieces of recording material P is picked up at the same time, a separation conveyance roller pair 14 separates the recording material P piece by piece and conveys the recording material P. The recording material P sent out by the paper feeding unit 12 passes through a transfer path included in a conveyance unit 20 and is conveyed to a registration unit 30. The registration unit 30 corrects the skew and timing, and then the recording material P is transmitted to the secondary transfer part N2.

An image forming operation will be described with an example of forming a full-color image. The charge device 99 uniformly charges the surfaces of the rotating photosensitive members 91. The exposure device 93 emits light based on a signal of image information transmitted to the image forming apparatus 100, and the light arbitrarily passes through a reflection unit 94 and exposes the charged surfaces of the photosensitive members 91. As a result, electrostatic latent images (electrostatic images) are formed on the photosensitive members 91. The development apparatus 92 uses toners to develop the electrostatic latent images formed on the photosensitive members 91, and toner images are formed on the photosensitive members 91. The primary transfer rollers 45 provide a predetermined welding pressure and electrostatic load bias to the toner images formed on the photosensitive members 91 at the primary transfer parts N1, and the toner images are transferred to the intermediate transferring member 40 (primary transfer). The cleaner 95 collects the toners slightly remained on the photosensitive members 91 (transfer remaining toners) after the primary transfer process. In the formation of a full-color image, the toner images formed on the photosensitive members 91 at the image forming parts 90 are primarily transferred to be sequentially placed on top of each other on the intermediate transferring member 40, and a multiple toner image for full-color image is formed on the intermediate transferring member 40.

The toner images on the intermediate transferring member 40 are transmitted to the second transfer part N2 at a predetermined timing. The secondary transfer inner roller 43 and the secondary transfer outer roller 44 provide a predetermined welding pressure and electrostatic load bias at the secondary transfer part N2, and the toner images on the intermediate transferring member 40 are transferred to the recording material P (secondary transfer).

Although the image forming apparatus 100 of the present embodiment forms an image by four colors of yellow, magenta, cyan, and black, the colors are not limited to four colors. For example, pale yellow, pale magenta, and pale cyan may be used to form an image. The alignment of the image forming parts 90 for each color is not limited to that of the present embodiment.

The pre-fixation conveyance unit 51 conveys, to the fixation apparatus 50, the recording material P with the secondarily transferred toner images. The fixation apparatus 50 uses opposing rollers or a belt to apply pressure to and heat the recording material P carrying the unfixed toner images and melts and fixes the toners on the recording material P. In the present embodiment, the fixation apparatus 50 includes a fixation roller including a halogen heater as a heat source and includes a pressure roller for pressure welding.

The branch conveyance device 60 selects a conveyance path for the recording material P with the image fixed by the fixation apparatus 50. The recording material P is conveyed to the surface processing apparatus 200 or is conveyed to a reverse conveyance device 71 if double-sided image formation is necessary.

If the double-sided image formation is necessary, a switch back operation is executed to switch the leading and trailing edges of the recording material P that is transmitted to the reverse conveyance device 71 and that includes the image fixed on a first side. The recording material P is conveyed to a double-sided transfer device 80. The recording material P is merged from a paper re-feeding path included in the conveyance unit 20 in accordance with timing of the recording material P of the following pages in a job (series of image forming operations for one or a plurality of recording materials based on an image formation start instruction) conveyed by the paper feeding apparatus 10. As in the case of conveyance from the paper feeding apparatus 10, the recording material P is transmitted to the secondary transfer part N2 for transferring an image on a second side. The image forming process is the same as for the first side.

The color toners are fine powders including a resin and a pigment as principal components. In the present embodiment, the color toners mainly include a polyester resin and a pigment.

In the image forming apparatus 100, there is a predetermined width (330 mm in the present embodiment) in a direction substantially orthogonal to the conveyance direction, and the recording material P with a predetermined length in the conveyance direction can be conveyed. In the present embodiment, the width in a main scanning direction of an image writable area in the image forming apparatus 100 is 326 mm, and the length in a sub scanning direction is 483 mm. The margin on the recording material P where the image will not be written is set to 2 mm throughout the entire perimeter (inward from edges of four sides of the rectangle).

In the image forming apparatus 100, the main scanning direction is a direction corresponding to a rotational axis direction of the photosensitive member 91 in the present embodiment and is a direction substantially orthogonal to the conveyance direction of the recording material P. In the image forming apparatus 100, the sub scanning direction is a direction corresponding to the conveyance direction of the recording material P in the present embodiment and is a direction substantially orthogonal to the rotational axis direction of the photosensitive member 91.

The recording material P including images fixed on one or both sides is conveyed to the surface processing apparatus 200.

Figure 8:
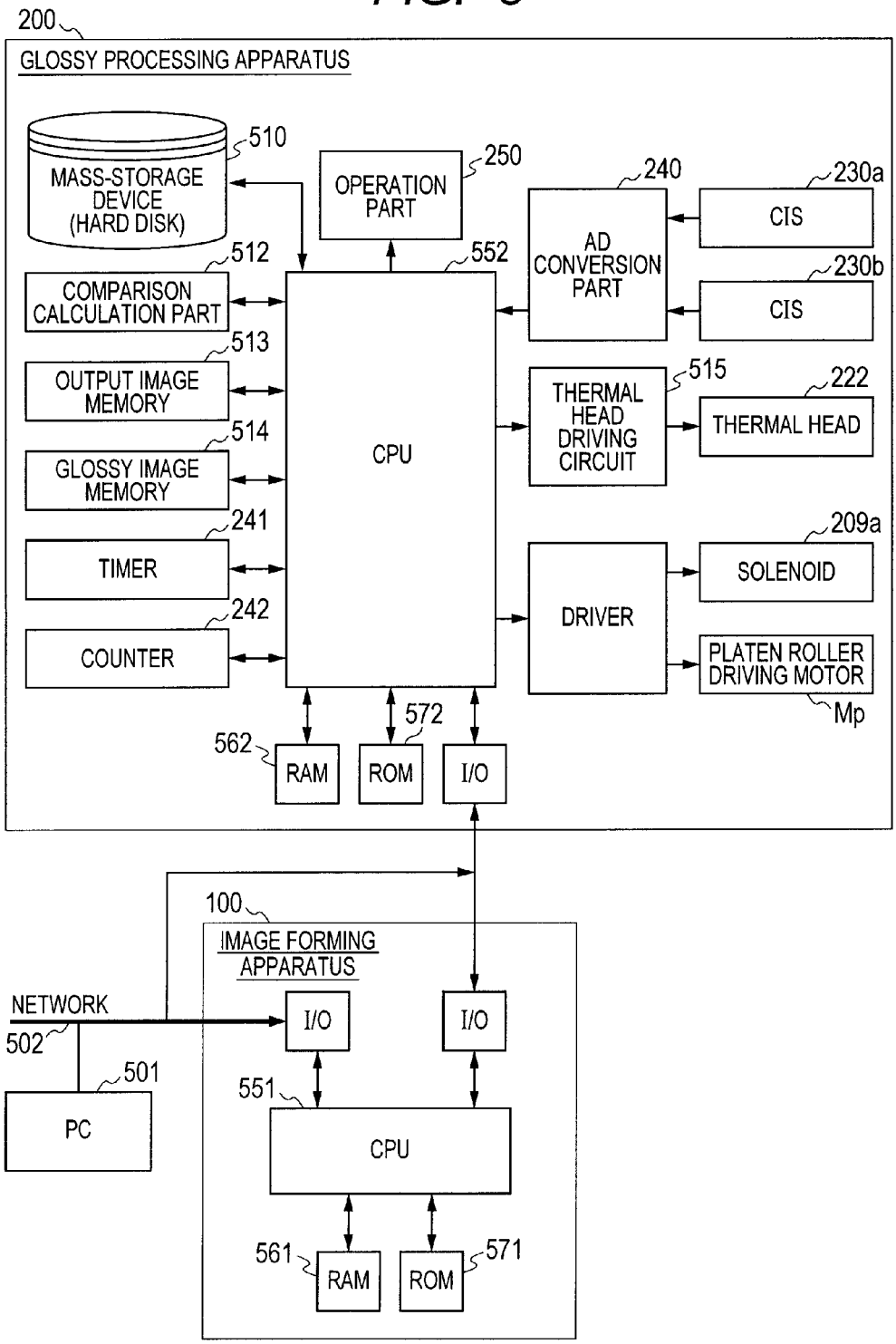
FIG. 8 is a block diagram illustrating a schematic control mode of an image forming system according to the embodiment.

FIG. 8 schematically illustrates the elements that control the image forming system 300 of the present embodiment. As illustrated in FIG. 8, the image forming apparatus 100 and the surface processing apparatus 200 include Central Processing Units (CPUs) 551 and 552 as control units, respectively, and can communicate each other through an interface. The CPUs 551 and 552 can mutually communicate information (for example, size, basis weight, and thickness) of the recording medium P (to-be-processed medium S), operation condition information (for example, jam and error), image information (such as amount of toner), page information, and the like.

The image forming apparatus 100 and the surface processing apparatus 200 can communicate with an external PC 501 through a network 502. The external PC 501 can transfer image data and issue an operation command. Control programs of components of the image forming apparatus 100 and the surface processing apparatus 200 are stored in ROMs (Read-Only Memories) 571 and 572 as storage devices, respectively. If necessary, the CPUs 551 and 552 use, as work areas, RAMs (Random Access Memories) 561 and 562 as storage devices of the image forming apparatus 100 and the surface processing apparatus 200, respectively.

3. Surface Processing Apparatus

With reference to FIG. 1, the recording material P as the to-be-processed medium S (FIG. 2) is transferred from the image forming apparatus 100 to the surface processing apparatus 200. Conveyance rollers 201 and 202 guide the to-be-processed medium S to a surface processing unit 220. The surface processing unit 220 executes glossy processing in accordance with glossy image data (processing area information) for the to-be-processed medium S. The to-be-processed medium S then passes through the discharge roller 205 and is discharged to the outside of the apparatus. If glossy processing is necessary for the back side of the to-be-processed medium S, a solenoid 209*a* (FIG. 8) operates a deflection flapper 209 to guide the to-be-processed medium S, which is applied with the glossy process of the first side, to a reverse conveyance part 210. The reverse conveyance part 210 performs a switchback operation to switch the leading and trailing edges of the to-be-processed medium S. The to-be-processed medium S is guided again to the surface processing unit 220 through a post-reversal conveyance unit 211, and the glossy processing of the second side is executed.

A paper feeding apparatus 240 is arranged on the surface processing apparatus 200 to allow using, as the to-be-processed medium S, the recording material P that is output with an image formed by an image forming apparatus outside of the image forming system 300 without using the image forming apparatus 100 connected to the surface processing apparatus 200. An operation of the paper feeding apparatus 240 is the same as that of the paper feeding apparatus 10 of the image forming apparatus 100, and the description will not be repeated.

The surface processing apparatus 200 includes an operation unit 250 controlled by the CPU 552 in the apparatus. For example, when the surface processing apparatus 200 operates alone, the user can perform an operation through the operation unit 250.

As illustrated in FIG. 8, the PC 501 transfers glossy image data and output image data as an original image through the network 502. The glossy image data defining a glossy processing area is stored in a glossy image memory 514 in the surface processing apparatus 200. The output image data defining an output image that is recorded in the recording material P and output from the recording material P is stored in an output image memory 513 in the surface processing apparatus 200. The data can be temporarily stored in a mass-storage device 510, and the operation unit 250 can later call out and use the data in the process. When the image forming apparatus 100 is used, the output image data is also transferred to the image forming apparatus 100 at the same as the transfer of the glossy image data and the output image data to the surface processing apparatus 200. Obviously, the data may be directly transferred from a USB or a memory such as an SD card to the surface processing apparatus 200 and the image forming apparatus 100, without the network.

The surface processing apparatus 200 can also be individually used without being connected to the image forming apparatus 100. In this case, the output image data of the output image formed on the to-be-processed medium S and the glossy image data of the glossy image to be provided to the to-be-processed medium S are input by an input unit such as the PC 501 as described above and are stored in the output image memory 513 and the glossy image memory 514.

Figure 2:
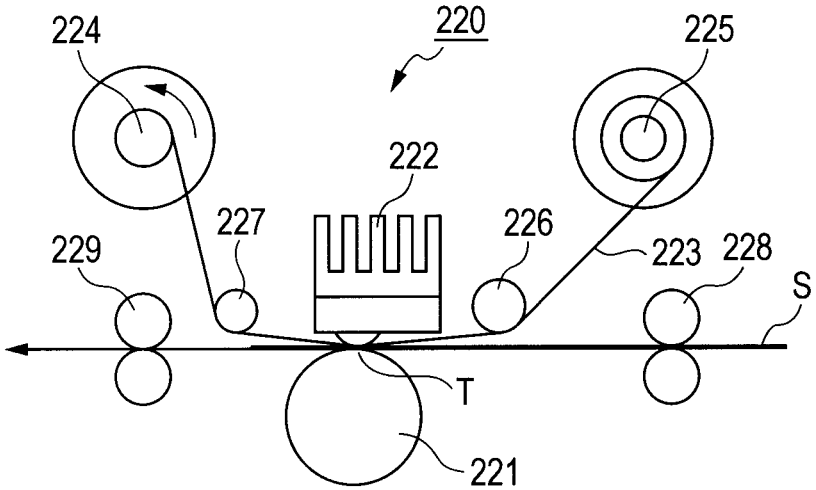
FIG. 2 is a schematic cross-sectional view of a surface processing unit of the surface processing apparatus according to the embodiment.

The surface processing unit 220 will be described in detail. FIG. 2 is a schematic cross-sectional view of the surface processing unit 220. The surface processing apparatus 200 includes a platen roller 221 that is a roller-type platen as a support member and a thermal head 222 that is a contact-type local heating device as a heating unit, and the platen roller 221 and the thermal head 222 are arranged facing each other across the conveyance path of the to-be-processed medium S. The thermal head 222 selectively generates heat according to glossy image data (processing area information) described later. The thermal head 222 is pressurized against the platen roller 221 through a film 223 described later. The platen roller 221 is a roller with a highly heat-resistant silicone rubber on the surface. A platen roller driving motor Mp (FIG. 8) as a drive source rotates and drives the platen roller 221, and the platen roller 221 serves as a conveyance unit to convey the to-be-processed medium S.

The surface processing apparatus 200 further includes: the film 223 pressed against the to-be-processed medium S and selectively heated by the thermal head 222; a take-up axis 224 as a take-up unit of the film 223; and a supply axis 225 as a supply unit of the film 223. A take-up axis driving motor (not illustrated) as a drive source rotates and drives the take-up axis 224. The take-up axis driving motor can rotate and drive the take-up axis 224 in a direction of taking up the film 223 from the supply axis 225 to the take-up axis 224. In this case, the supply axis 225 can rotate in the direction of supplying the film 223 to the take-up axis 224. An energization unit for energizing the supply axis 225 to cause the supply axis 225 to rotate in the opposite direction to prevent a slack of the film 223 may be provided.

A surface of the film 223 that touches the to-be-processed medium S will be called a front surface, and a surface on the opposite side will be called a back surface. A surface of the to-be-processed medium S that touches the film 223 will be called a front surface, and a surface on the opposite side that touches the platen roller 221 will be called a back surface.

The surface processing apparatus 200 further includes a first guide roller 226 and a second guide roller 227 arranged to be in contact with the back surface of the film 223. Rotational axis directions of the supply axis 225, the take-up axis 224, the platen roller 221, the first guide roller 226, and the second guide roller 227 are substantially parallel. The film 223 is drawn out from the supply axis 225, wound around part of the outer periphery of the first guide roller 226, and guided to a processing part T as a pressing part (nip) between the thermal head 222 and the platen roller 221. Passing through the processing part T, the film 223 is wound around part of the outer periphery of the second guide roller 227, guided to the take-up axis 224, and taken up by the take-up axis 224. The conveyance direction of the film 223 will be called a forward direction. The conveyance direction of the film 223 is substantially orthogonal to the rotational axis directions of the supply axis 225, the take-up axis 224, the platen roller 221, the first guide roller 226, and the second guide roller 227. In the surface processing of the to-be-processed medium S, the conveyance directions of the film 223 and the to-be-processed medium S at the processing part T are the same direction. The first guide roller 226 and the second guide roller 227 are rotatable guide rollers stretched around the film 223. The first guide roller 226 and the second guide roller 227 rotate along with the conveyance of the film 223.

On the upstream side of the processing part T in the conveyance direction of the to-be-processed medium S, the surface processing apparatus 200 further includes a registration roller pair 228 that adjusts the posture of the to-be-processed medium S before processing and that is a pair of rollers pressed against each other. A registration roller driving motor (not illustrated) as a drive source rotates and drives the registration roller pair 228. The registration roller pair 228 corrects the skew of the to-be-processed medium S and then conveys the to-be-processed medium S to the processing part T. The skew of the to-be-processed medium S is corrected when the leading edge in the conveyance direction hits a contact part (nip) of the registration roller pair 228 in which the rotation is terminated.

On the downstream side of the processing part T in the conveyance direction of the to-be-processed medium S, the surface processing apparatus 200 further includes a conveyance roller pair 229 that is a pair of rollers pressed against each other. The conveyance roller pair 229 conveys the processed to-be-processed medium S to a discharge tray (not illustrated) outside of the surface processing apparatus 200 or to post-processing.

Figure 5:
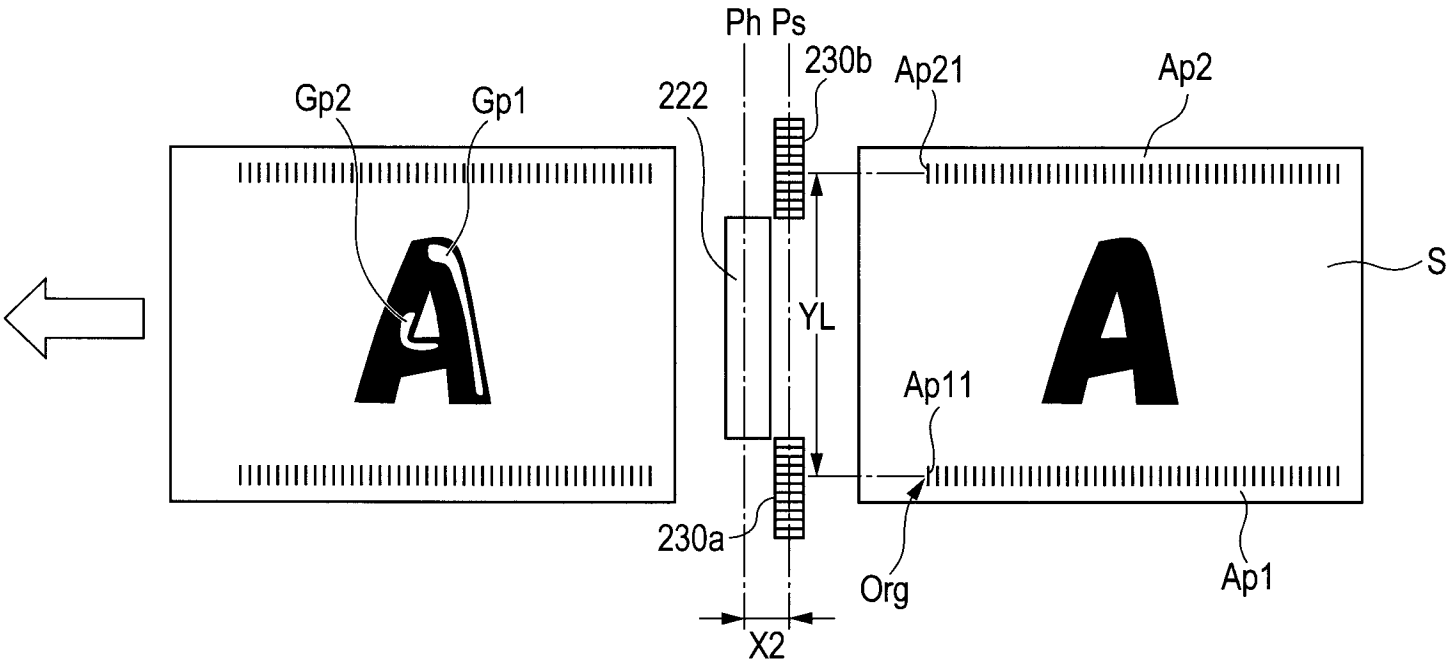
FIG. 5 is a schematic diagram viewing near the thermal head of the surface processing apparatus from above according to the embodiment.

On the downstream side of the registration roller pair 228 in the conveyance direction of the to-be-processed medium S and on the upstream side of the thermal head 222, contact image sensors 230*a* and 230*b* described in detail later are arranged on the surface processing apparatus 200 (FIGS. 5 and 8).

Figure 3:
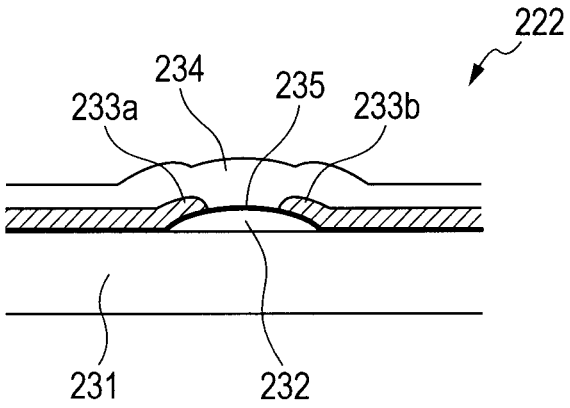
FIG. 3 is a schematic cross-sectional view illustrating an example of a configuration of a thermal head.

FIG. 3 is a schematic diagram of a configuration of a heating element of the thermal head 222. The thermal head 222 forms a common (shared) electrode 233*a* and a lead (individual) electrode 233*b* over a glaze 232 (heat-retention layer) printed on a substrate 231 containing alumina and forms a heat resistor 235 over the upper surface of the electrodes. A protection film 234 (overcoat layer) is further formed over the upper surface of the substrate 231, the heat-retention layer 232, the electrodes 233*a* and 233*b*, and the heat resistor 235. A driving circuit 515 (FIG. 8) for selectively applying electric power to the heating element for heat generation is connected to the thermal head 222. The thermal head 222 further includes a member such as a heat releasing plate that releases excess heat after providing heat to the to-be-processed medium S. The thermal head 222 includes a plurality of heating elements (heating parts) straightly arranged in a direction substantially orthogonal to the conveyance direction of the to-be-processed medium S. The thermal head 222 can selectively heat different areas in the arrangement direction to heat the surface of the to-be-processed medium S through the film 223.

The heating element density of the thermal head 222 used in the present embodiment is 300 dpi, the recording density (processing density) is 300 dpi, the drive voltage is 30 V, and the heating element average resistance value is 5000Ω. However, the configuration and the specifications of the thermal head 222 are not limited to those of the present embodiment.

Figure 4:
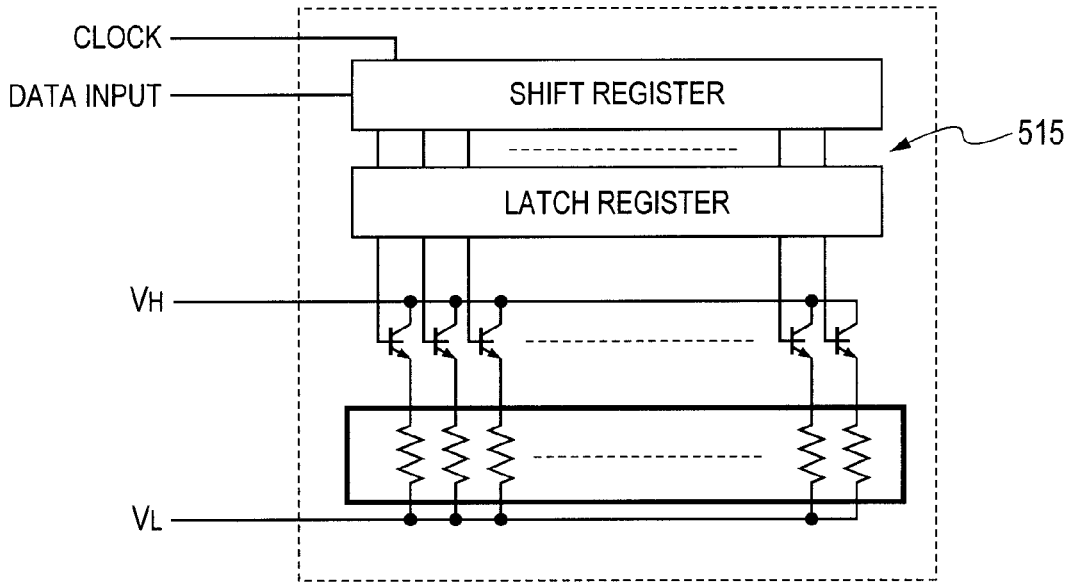
FIG. 4 is a circuit diagram illustrating an example of a driving circuit of the thermal head.

FIG. 4 is a schematic diagram of a driving circuit of a typical thermal head 222. A heat resistor for one line is arranged on the alumina substrate, and electrodes are wired on both sides of the heat resistor. A driver IC including a register group that transfers and holds data (processing area information) of one line is arranged on the same alumina substrate or on a separate wiring board.

The platen roller 221 is an elastic roller formed in a roller shape from an elastic layer made of a member with a high friction factor such as hard rubber around an axis (cored bar). In the present embodiment, the platen roller 221 is a heat-resistant rubber roller formed in a roller shape from an elastic layer made of silicone rubber around the axis. Through the axis, the platen roller 221 can rotate and is attached to the main body of the surface processing apparatus 200. A platen roller driving motor (not illustrated) as a drive source rotates and drives the platen roller 221 through the axis to convey the to-be-processed medium S and the film 223. In the present embodiment, the conveyance speed of the to-be-processed medium S is determined by the rotation speed of the platen roller 221, and the data (processing area information) transmitted to the thermal head 222 is determined based on the rotation speed of the platen roller 221. In the present embodiment, the to-be-processed medium S and the film 223 are conveyed in the same direction at a substantially equal speed at the processing part during the surface processing.

The film (transfer film) 223 is taken up and stored by the supply axis 225 at a desired length. The film 223 is taken up by the take-up axis 224 as necessary and supplied to the processing part T. The thermal head 222 presses the film 223 against the platen roller 221 along with the to-be-processed medium S, or the thermal head 222 selectively heats the film 223. Since local heat of the thermal head 222 is transmitted to the surface of the to-be-processed medium S through the film 223, it is desirable to form the film 223 by a thin flexible material. From that viewpoint, it is desirable that the thickness of the film 223 is 40 μm or less. Although the thickness of the film 223 can be as thin as 2 μm from the viewpoint of glossy processing, it is suitable if the thickness is 4 μm or more from the viewpoint of strength. It is effective if the film 223 has some stiffness to obtain excellent surface quality in the image clarity of the photographic tone in the surface processing, and it is suitable that the thickness of the film 223 is 8 μm or more in the following materials. The materials need to be heat-resistant to the thermal head 222. Materials with heat resistance over 200 degrees centigrade such as polyimide are desirable. Although the heating history remains, an inexpensive, general resin film (thermoplastic film), such as PET (polyethylene terephthalate), can be adopted. A mold release coating can be applied to the surface of the film 223 (surface touching the to-be-processed medium S). This functional layer is a coating layer with low surface energy, and the functional layer can be applied to improve the mold releasing property between the film 223 and the resin on the surface of the to-be-processed medium S. In the transfer of the shape on the surface of the film 223 to the surface of the to-be-processed medium S, it is desirable to smoothly release the mold from the viewpoint of accurate transfer of the shape of the film 223. For example, a fluororesin and a silicone resin can be used for the compositions. Although the coating can be used as a formation method, the method is not limited to the coating. It is important to be able to form the surface quality to be transferred. For example, to create a smooth surface for a photograph, a smooth surface can be created on the base film by coating. A stick prevention layer can be provided to the back surface of the film 223 (surface that slides relative to the thermal head 222). The layer can be applied to reduce the mechanical friction with the thermal head 222. Characteristics close to the mold releasing coating are required. Specifically, coating based on a fluororesin or a silicon resin as in the mold releasing layer is effective. In the film 223 used in the present embodiment, mold release coating is applied to a PET film (base material) with a thickness of 10 μm.

If the film 223 is a highly glossy smooth film to transfer the surface shape (surface property) to the to-be-processed medium S, the film 223 can be processed to a glossy surface with a highly glossy photographic tone. Conversely, a reversed shape of the shape can be transferred to the to-be-processed medium S using a matte film based on sand blast or using a film provided with a specific shape. For example, shapes of various textures, such as a matte finish, a Japanese paper, and an embossed paper, can be transferred. Geometric patterns can also be applied, and various textures such as a lattice can be transferred. A geometric structure of 1 μm to a sub μm order can be created to transfer a surface in hologram colors. The surface processing apparatus 200 of the present embodiment allows partial processing. Therefore, a plurality of different types of films 223 can be provided to apply various shapes and hologram colors only to necessary locations.

In the present embodiment, the width of the film 223 in a direction substantially orthogonal to the conveyance direction is 300 mm, and the width of the thermal head 222 in the same direction is an equivalent width. As a result, to-be-processed media S in various sizes up to about A3 size can be handled. In the present embodiment, the surface of the film 223 is smooth, which is for providing gloss to the to-be-processed medium S. In the present embodiment, a thermoplastic film with a thickness of 10 μm is used as the film 223. Therefore, once the film 223 is used, wrinkles are generated at the heated part, and the film 223 cannot be reused.

A section (separation part) for separating the to-be-processed medium S from the film 223 can be formed at the position of the film 223 where the film 223 is wound around part of the outer periphery of the second guide roller 227. In this case, the second guide roller 227 plays two roles: a cooling function of the film 223; and a separation function of the to-be-processed medium S from the film 223 based on the curvature. The second guide roller 227 can be formed by a metallic roller such as SUS. A cooling mechanism may also be arranged to suppress an increase in the temperature of the separation part. For the cooling mechanism, it is effective to provide an air-cooling mechanism or to attach a cooling fin. To separate the to-be-processed medium S and the film 223, for example, a case of the thermal head 222 may be used to curve the film 223 to separate the to-be-processed medium S from the film 223.

4. Basic Operation of Surface Processing

For example, the to-be-processed medium S conveyed piece by piece from the image forming apparatus 100 to the surface processing unit 220 is conveyed to the position of the registration roller pair 228 and is temporarily stopped to correct the skew. When the registration roller pair 228 is driven to restart the conveyance of the to-be-processed medium S, the first and second contact image sensors 230*a* and 230*b* described later detect the leading edge of the to-be-processed medium S in the conveyance direction. As described later, the timing of driving the thermal head 222 is controlled in accordance with the detection results of the first and second contact image sensors 230*a* and 230*b*. The to-be-processed medium S is conveyed to the processing part T where the thermal head 222, which includes straightly aligned heat resistors, and the platen roller 221 form a nip. At the processing part T, the platen roller 102 and the thermal head that selectively generates heat face each other across the conveyance path of the to-be-processed medium S. The film 223 is transferred below the thermal head 222, and the to-be-processed medium S is conveyed below the film 223. The thermal head 222 and the platen roller 221 sandwich and convey the film 223 along with the to-be-processed medium S. The thermal head 222 can selectively heat the heat resistors based on a heating pattern determined in accordance with the processing area information as described later. The thermal head 222 melts again the toner images on the to-be-processed medium S, while the thermal head 222 and the platen roller 221 sandwich and convey the film 223 and the to-be-processed medium S. The film 223 is separated from the to-be-processed medium S at the separation part on the downstream side of the thermal head 222 in the conveyance direction of the to-be-processed medium S. At this point, the to-be-processed medium S is sufficiently cooled. Therefore, the toner images on the surface of the to-be-processed medium S are solidified while the surface quality of the film 223 is transferred, and desired gloss can be provided to the surface of the to-be-processed medium S.

The take-up axis 224 takes up the film 223 conveyed along with the conveyance of the to-be-processed medium S, and at the same time, generates a tension necessary to separate the film 223 and the to-be-processed medium S at the separation part. The thermal head 222 can be held apart from the platen roller 221 in a normal state. The thermal head 222 can be pressed against the platen roller 221 in accordance with the timing when the start position of the processing area of the to-be-processed medium S reaches the processing part T, and the thermal head 222 can be separated from the platen roller 221 after the end position of the processing area passes through the processing part T. In this case, the take-up axis 224 can be driven when the thermal head 222 is pressed against the platen roller 221 and can be terminated when the thermal head 222 is separated.

The conveyance roller pair 209 discharges the to-be-processed medium S applied with the surface processing to the outside of the surface processing unit 220.

In general, the high glossiness of the photographic tone denotes high glossiness of 40% or more, or 80% or more, at 60-degree-gloss (JIS Z 8741, mirror surface glossiness-measurement method). In the conventional glossy processing methods, it is difficult to partially apply glossy processing of the photographic tone to areas that are different piece by piece. According to the surface processing apparatus 100 of the present embodiment, a photographic area, such as upper half of the to-be-processed medium, can be of course processed, and partial glossy processing can be executed for arbitrary shape and area in accordance with headline characters and print content.

In the present embodiment, the take-up axis driving motor rotates the take-up axis 224 to take up the film 223 around the periphery of the take-up axis 224, and the film 223 is conveyed while moving at a substantially equal speed as the to-be-processed medium S at the processing part T. Therefore, the surface of a new film 223 always comes in contact with the to-be-processed medium S in the glossy processing. However, a film of an endless belt may be used if the effect on the durability of the surface property of the film is small.

5. Positioning

FIG. 5 is a schematic diagram showing a view near the thermal head 222 from above (vertical direction relative to the surface of the to-be-processed medium S conveyed to the processing part T). The width in the longitudinal direction of the thermal head 222 and the width in a direction substantially orthogonal to the conveyance direction of the film 223 are 300 mm, and the length allows applying the glossy processing to the entire area of the A3 width. As described, the image forming apparatus 100 can convey the recording material P with a width of 330 mm in the direction substantially orthogonal to the conveyance direction, and the surface processing apparatus 200 can covey the to-be-processed medium S with a width of 330 mm in the direction substantially orthogonal to the conveyance direction.

The longitudinal direction of the thermal head 222 in the surface processing apparatus 200 (arrangement direction of the line-shaped heating unit) is a direction substantially orthogonal to the conveyance direction of the to-be-processed medium S, and the direction is set to be substantially the same direction as the main scanning direction in the image forming apparatus 100. Hereinafter, the longitudinal direction of the thermal head 222 in the surface processing apparatus 200 will also be simply called the main scanning direction. The conveyance direction of the to-be-processed medium S in the surface processing apparatus 200 is a direction substantially orthogonal to the longitudinal direction of the thermal head 222, and the direction is set to be substantially the same direction as the sub scanning direction in the image forming apparatus 100. Hereinafter, the direction substantially orthogonal to the longitudinal direction of the thermal head 222 in the surface processing apparatus 200 will also be simply called the sub scanning direction.

In the present embodiment, the first and second contact image sensors (hereinafter called "CISs") 230*a* and 230*b* as image detection units are arranged outside of both end portions in the longitudinal direction of the thermal head 222 and on the upstream side of the thermal head 222 in the conveyance direction of the to-be-processed medium S. More specifically, a focal position Ps of the first and second CISs 230*a* and 230*b* is outside of the both end portions in the longitudinal direction of the thermal head 222 and is at a position with a 1 mm interval (X2) from the heating position Ph of the thermal head 222 toward the upstream side in the conveyance direction of the to-be-processed medium S.

Through the first and second CISs 230*a* and 230*b*, the surface processing apparatus 200 can detect the leading edge of the to-be-processed medium S and the image formed on the to-be-processed medium S. The resolution of the first and second CISs 230*a* and 230*b* is 600 dpi in both the main scanning direction and the sub scanning direction.

In the present embodiment, the first and second CISs 230*a* and 230*b* are used to position the image (output image) and the glossy processing area (glossy image) formed on the to-be-processed medium S.

More specifically, in the present embodiment, the image forming apparatus 100 first forms an output image on the recording material P according to the output image data. The image forming apparatus 100 handles the recording material P provided with the output image as the to-be-processed medium S to execute glossy processing. As described, the position and/or the size of the output image on the recording material P may be a little different from the output image data due to the accuracy of the image forming apparatus 100 or particularly due to moisture if the recording material P is paper.

In the present embodiment, to bring the position of the glossy image in line with the output image on the recording material P, i.e. the to-be-processed medium S, the heating position of the thermal head 222 for obtaining the glossy image is corrected in accordance with the actual position and/or the size of the output image on the to-be-processed medium S.

In the present embodiment, the image forming apparatus 100 locates the both end portions in the main scanning direction in the formation of the output image and writes correction patterns Ap1 and Ap2 on the recording material P, i.e. the to-be-processed medium S. Although the correction patterns Ap1 and Ap2 can be formed in an arbitrary color as long as the first and second CISs 230*a* and 230*b* can detect the patterns, the patterns are formed in black in the present embodiment. The first and second CISs 230*a* and 230*b* read the correction patterns Ap1 and Ap2. In this way, a minute positional displacement between the output image on the to-be-processed medium S and the output image data as a basis of the output image is detected, and the heating position of the thermal head 222 for obtaining the glossy image is corrected in accordance with the displacement. In the present embodiment, detection signals of the first and second CISs 230*a* and 230*b* are input to the CPU 552 through an AD conversion part 240 (FIG. 8). The pattern for correction does not have to be separately provided for an image to be output to a sheet designated by the user if the distance before heating can be acquired.

In the present embodiment, the correction patterns Ap1 and Ap2 include lines (line width is 1 pixel) in the main scanning direction (substantially right-angle direction relative to the conveyance direction of the recording material P) aligned in the sub scanning direction (conveyance direction of the recording material P) at 1/30 inch (about 0.85 mm) intervals. The setting of the intervals of the correction patterns Ap1 and Ap2 is selected due to the following reason. In the present embodiment, the thermal head 222 is driven with the resolution of 300 dpi in the main scanning direction and the resolution of 300 dpi also in the sub scanning direction. Therefore, setting the intervals to 1/30 inch, which is ten times the 300 dpi, reduces calculation errors. In this way, in the present embodiment, the image detection unit 230 detects the plurality of correction images Ap arranged at equal intervals in the conveyance direction of the to-be-processed medium S indicated by the correction image information. In the present embodiment, the intervals of the plurality of correction images Ap arranged at equal intervals in the conveyance direction of the to-be-processed medium S indicated by the correction image information are integral multiple of the resolution of the heating unit 222 in the conveyance direction of the to-be-processed medium S.

The image forming apparatus 100 forms the correction patterns Ap1 and Ap2 at the same time, as part of the output image on the recording material P. More specifically, the positional relationship between the correction pattern data defining the correction patterns Ap1 and Ap2 and the output image data defining the output image is clear. Therefore, the positional relationship between the correction pattern data defining the correction patterns Ap1 and Ap1 and the glossy image data defining the glossy image (for example, white sections of Gp1 and Gp2 in FIG. 5) is also clear. In the present embodiment, the correction pattern data is transferred to the surface processing apparatus 200 along with the output image data and stored in the output image memory 513 in the surface processing apparatus 200. Alternatively, the correction pattern data can be temporarily stored in the mass-storage device 510 along with the output image data, and the operation unit 250 can later call out and use the data in processing. As described, the data can be transferred from a network or a memory. The correction patterns may not be the patterns in the present embodiment as long as the image position can be detected.

Figure 9:
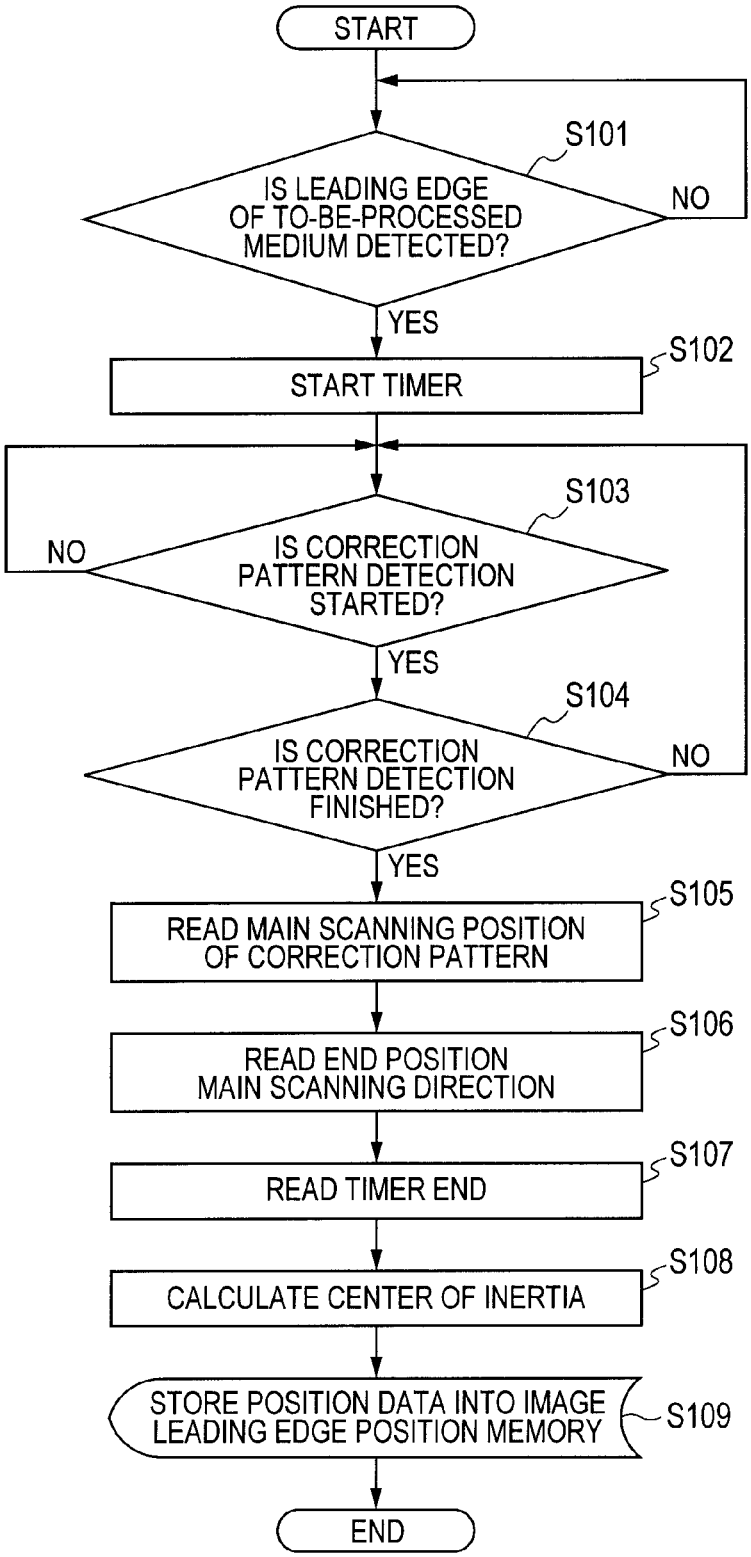
FIG. 9 is a flow chart diagram of an image position detection operation according to the embodiment.

A position detection process of the output image will be described with reference to a flow chart of FIG. 9. Although the flow chart of FIG. 9 illustrates a control flow of only the first CIS 230*a*, the control flow of the second CIS 230*b* is the same. Therefore, the control flow of the second CIS 230*b* will not be described.

In the present embodiment, the control program is stored in the ROM 572 of the surface processing apparatus 200, and the CPU 552 executes controls in accordance with the control program while properly using the RAM 562 as a work area.

When the first CIS 230*a* detects the leading edge in the conveyance direction of the to-be-processed medium S transmitted by the conveyance rollers 201 and 202 (S101), a timer 241 (FIG. 8) starts measuring the time (S102). The first CIS 230*a* starts a detection operation of a first correction pattern Ap11 (S103). When the to-be-processed medium S is conveyed and the first correction pattern Ap11 (FIG. 5) is detected, the detection operation of the first correction pattern Ap11 is finished (S104). The conveyance speed of the to-be-processed medium S is determined. This allows recognizing the distance from the leading edge of the to-be-processed medium S in the conveyance direction to the first correction pattern Ap11, i.e. the leading edge position of the output image on the to-be-processed medium S in the conveyance direction of the to-be-processed medium S. At substantially the same time, the first CIS 230*a* reads the position of the first correction pattern Ap11 in the main scanning direction (S105) and further reads the position of the end portion in the main scanning direction of the to-be-processed medium S in the present embodiment (S106). The measurement of time by the timer 241 is finished (S107). The CPU 552 finds out the position of the first correction pattern Ap11 based on the measurement result of time from the leading edge of the to-be-processed medium S to the first correction pattern Ap11 obtained by the timer 241 to calculate a center of inertia Org of the first correction pattern Ap11 (S108). The CPU 552 stores the calculated center of inertia Org of the first correction pattern Ap11 in the RAM 562 as an image leading edge position memory (S109).

Figure 10:
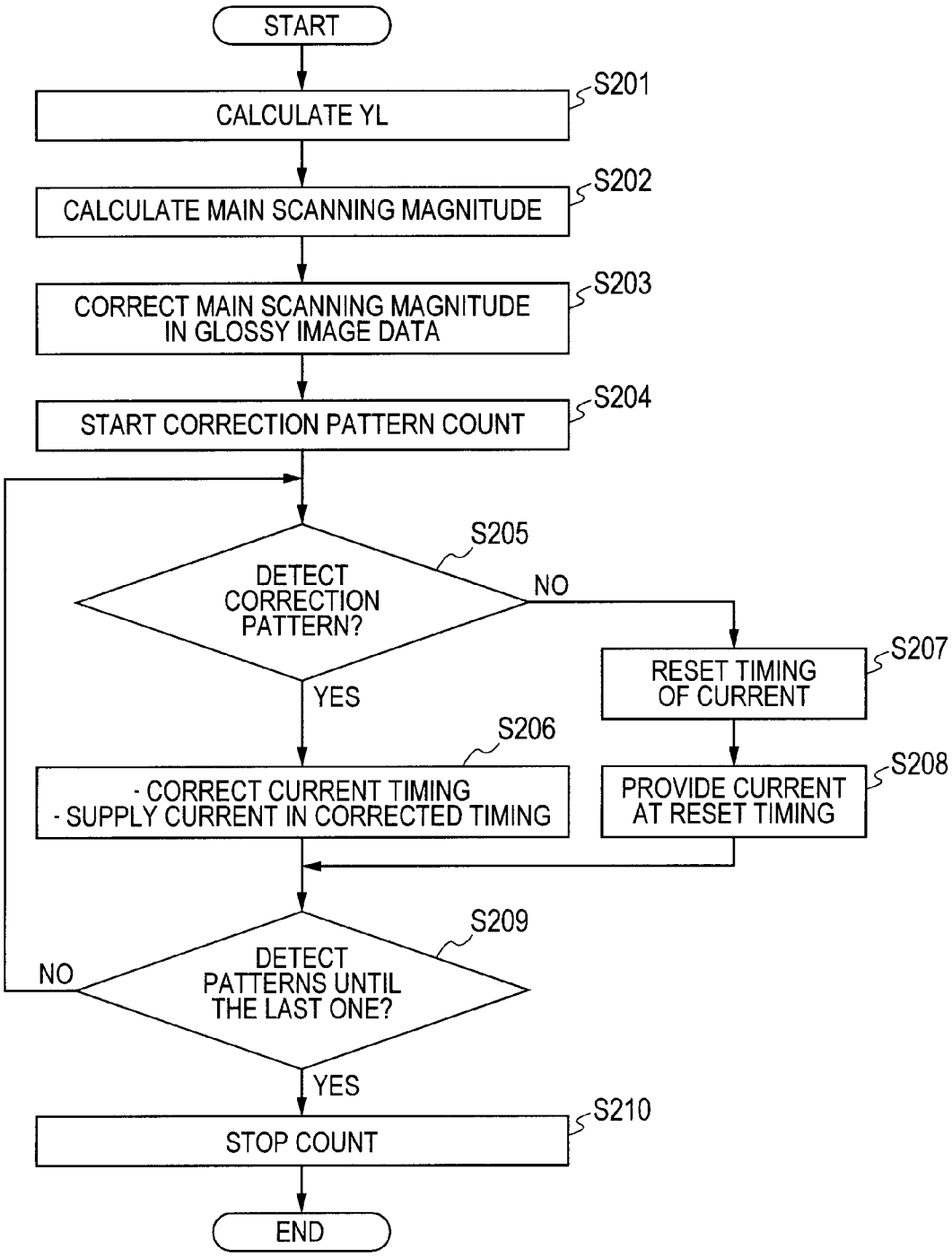
FIG. 10 is a flow chart diagram of a heating position control operation according to the embodiment.

A process of correcting the glossy image data based on the position detection result of the output image to control the heating operation of the thermal head 222 will be described with reference to a flow chart of FIG. 10. To simplify the understanding, a case in which the image is conveyed to the processing part T without a tilt as illustrated in FIG. 5 will be described first.

The position and the magnitude in the main scanning direction are corrected as follows. The CPU 552 first calculates a distance between centers of inertia YL of the first correction patterns Ap11 and Ap21 at both end portions in the main scanning direction read by the first and second CISs 230*a* and 230*b*, respectively (S201). More specifically, the distance between the first CIS 230*a* and the second CIS 230*b* in the main scanning direction is fixed. Therefore, the CPU 552 can calculate the distance between centers of inertia YL from the centers of inertia Org of the first correction patterns Ap11 and Ap21 stored in the RAM 562 as an image leading edge position memory. The comparison calculation part 512 compares a theoretical distance between centers of inertia of corresponding correction patterns Ap11 and Ap21 of the output image data in the output image memory 513 with the distance between centers of inertia YL to calculate the magnitude of the output image in the main scanning direction (S202). In the present embodiment, the output image data in the output image memory 513 includes the correction pattern data. Therefore, the shrinkage or enlargement of the actual image on the to-be-processed medium S relative to the output image data in the main scanning direction is calculated. The CPU 552 corrects the glossy image data in the main scanning direction read from the glossy image memory 514 in accordance with the calculated magnitude of the output image in the main scanning direction (S203). More specifically, the magnitude of the glossy image in the main scanning direction is corrected in line with the magnitude of the output image in the main scanning direction. In this case, the CPU 552 uses the center of inertia Org of the first correction pattern Ap11 read by the first CIS 230*a* as a reference (origin) of correction and determines the heating position in the main scanning direction of the thermal head 222 based on the information. Transparent image data after the correction is temporarily stored in the RAM 562.

In general, the magnitude of the output image in the main scanning direction does not change much from the leading edge to the trailing edge in the conveyance direction of the to-be-processed medium S. Therefore, the magnitude calculated from the distance between centers of inertia YL of the first correction patterns Ap11 and Ap21 is reflected on the entire output image in the conveyance direction of the to-be-processed medium S in the present embodiment. However, if the change in the magnitude of the output image in the main scanning direction from the leading edge to the trailing edge in the conveyance direction of the to-be-processed medium S cannot be ignored, a plurality of correction patterns in the conveyance direction of the to-be-processed medium S may be used to recalculate the magnitude of the output image in the main scanning direction. For example, the magnitude of the output image in the main scanning direction can be recalculated every time the correction pattern is detected. Alternatively, correction patterns at the same order in the conveyance direction of the to-be-processed medium S among the correction patterns at both end portions in the main scanning direction can be used to recalculate the magnitude of the output image in the main scanning direction at least once.

Meanwhile, the position in the conveyance direction of the to-be-processed medium S is corrected as follows. In the present embodiment, while a counter 242 counts the number of correction patterns Ap1 detected by the first CIS 230*a* (S204), the heating timing of the thermal head 222 is corrected every time the correction pattern Ap1 is detected. More specifically, when the correction pattern Ap1 is detected (S205), the CPU 552 corrects the timing of energizing the elements of the thermal head 222 based on the glossy image data with the corrected magnitude in the main scanning direction (S206). The elements of the thermal head 222 are energized at the corrected timing of energization. The following is performed between the correction patterns in which the correction patterns are not detected. More specifically, based on the detection timing of the last correction pattern Ap1 (reset of timing of energization) (S207), the elements of the thermal head 222 are energized at predetermined timing based on the glossy image data after the magnitude in the main scanning direction is corrected (S208). The correction pattern data and the output image data are contrasted. Therefore, in the conveyance direction of the to-be-processed medium S, it can be recognized that the position of the output image between the position of one correction pattern and the position of the next correction pattern is a position at a predetermined distance from the position of the one correction pattern. The output image data and the glossy image data are contrasted. Therefore, in the conveyance direction of the to-be-processed medium S, it can be recognized that the position of the glossy image corresponding to the output image between the position of one correction pattern and the position of the next correction pattern is a position at a predetermined distance from the position of the one correction pattern. In this way, the CPU 552 can correct the heating timing of the thermal head 222 in the sub scanning direction. In the present embodiment, the correction is possible at intervals of about 0.85 mm. Therefore, even if the output image on the to-be-processed medium S is changed by 1% relative to the output image data, only an error of 8.5 μm occurs.

When the last correction pattern Ap1 is detected (or when the trailing edge in the conveyance direction of the to-be-processed medium S is detected) (S209), counting of the correction pattern Ap1 by the counter 242 is finished (S210), and the correction operation of the to-be-processed medium S is finished.

In the present embodiment, the position of the glossy image in the conveyance direction of the to-be-processed medium S is corrected by assuming that the actual output image is at the position away from the correction pattern Ap1 by a predetermined theoretical distance based on the output image data. However, the mode is not limited to this. The intervals of the correction patterns in the conveyance direction of the to-be-processed medium S may be detected, and the magnitude of the output image in the conveyance direction may be calculated from the detection result to further correct the position of the glossy image between the correction patterns. In this case, the interval between the correction patterns in the conveyance direction of the to-be-processed medium S can be calculated once (for example, the interval between the first and second correction patterns can be calculated) to calculate the magnitude of the entire output image in the conveyance direction of the to-be-processed medium S. Alternatively, the intervals between the correction patterns in the conveyance direction of the to-be-processed medium S can be calculated for a plurality of times (for example, the interval from the previous correction pattern can be calculated every time the correction pattern is detected) to calculate the magnitude of the output image between the correction patterns in the conveyance direction of the to-be-processed medium S.

Figure 6:
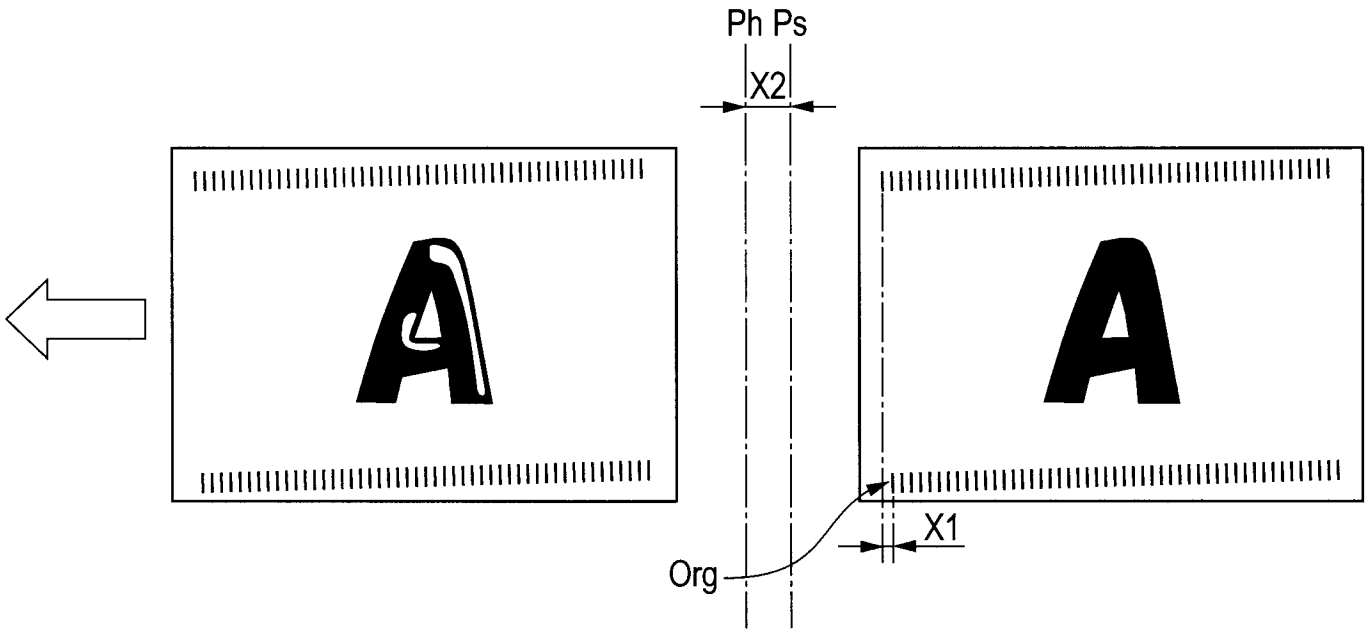
FIG. 6 is a schematic diagram illustrating an example of a state in which an image is tilted.
Figure 7:
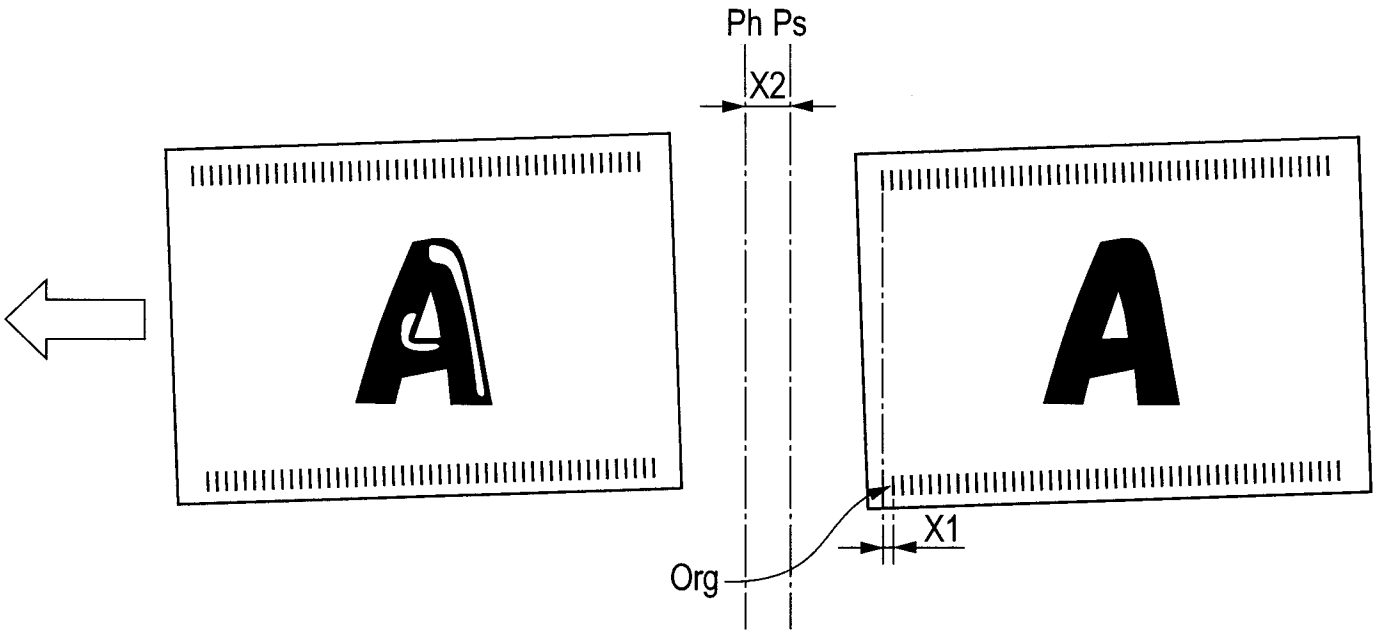
FIG. 7 is a schematic diagram illustrating another example of the state in which an image is tilted.

Cases in which the output image is tilted and conveyed to the processing part T will be described. Examples of the cases in which the output image is tilted and conveyed to the processing part T include a case in which the output image is tilted relative to the to-be-processed medium S (FIG. 6) and a case in which the output image is tilted and conveyed because the to-be-processed medium S is tilted and conveyed (FIG. 7). In the present embodiment, the tilt of the output image conveyed to the processing part T can be calculated as follows. The CPU 552 calculates a difference X1 between distances from the leading edge position of the to-be-processed medium S detected by the first and second CISs 230*a* and 230*b* to the positions of the first correction patterns Ap11 and Ap21 based on a different between the detection timings of the correction patterns Ap11 and Ap21. As a result, for the tilt of either case, the glossy image data can be corrected based on the center of inertia Org of a predetermined correction pattern (correction pattern Ap11 here) to position the output image and the glossy image. Specifically, in S202 of FIG. 10, the CPU 552 calculates the tilt of the output image from the distance X1 substantially at the same time as the calculation of the magnitude of the output image in the main scanning direction. In S203 of FIG. 10, the tilt is corrected relative to the transparent image data along with the correction of the magnitude in the main scanning direction.

Even if the tilt of the output image is detected to correct the glossy image, the heating process cannot be executed after the heating position Ph of the thermal head 222. Therefore, in the present embodiment, the focal position Ps of the first and second CISs 230*a* and 230*b* is shifted upstream by 1 mm (X2) from the heating position Ph of the thermal head 222 in the conveyance direction of the to-be-processed medium S as described above. As a result, if the distance X1 indicating the tilt of the output image combining the tilt of the output image relative to the to-be-processed medium S and the transfer tilt of the to-be-processed medium S is within 1 mm, the glossy heating process can be executed at an appropriate position. More specifically, the distance X1 is a distance converting, in the conveyance direction of the to-be-processed medium S, the tilts relative to the theoretical sub scanning direction indicated by the output image data and relative to the theoretical sub scanning direction of the output image conveyed to the processing part T. It is desirable that the distance between the heating position Ph of the thermal head 222 in the conveyance direction of the to-be-processed medium S and the focal position Ps of the first and second CISs 230*a* and 230*b* is greater than a predicted maximum value of the distance X1. More specifically, it is desirable that the distance between the heating position of the heating unit 222 in the conveyance direction of the to-be-processed medium S and the image detection position of the image detection unit 230 is greater than the maximum value of the distance obtained by converting the predicted size of the tilt into the size in the conveyance direction of the to-be-processed medium S.

Obviously, if the predicted tilt is greater than that of the present embodiment, the first and second CISs 230*a* and 230*b* may be arranged on further upstream in the conveyance direction of the to-be-processed medium S. However, if the distance from the heating position Ph of the thermal head 222 to the focal position Ps of the first and second CISs 230*a* and 230*b* is long, the error in the transfer accuracy of the to-be-processed medium S after the detection of the correction pattern may be large. Therefore, it is suitable to reduce the distance between the positions as much as possible to improve the accuracy of the heating position. For example, if the transfer variation of the to-be-processed medium S caused by the platen roller 221 is 1%, the position of the glossy image is displaced by only 10 μm in the present embodiment.

In this way, the surface processing apparatus 200 includes the conveyance unit (platen roller) 221 that conveys the to-be-processed medium S in the present embodiment. The surface processing apparatus 200 also includes the heating unit 222 that selectively heats different areas on the surface of the to-be-processed medium S in the direction substantially orthogonal to the conveyance direction of the to-be-processed medium S through the film 223. In the surface processing apparatus 200, the heating unit 222 executes the process of partially heating the surface of the to-be-processed medium S including the output image formed on the surface conveyed by the conveyance unit 221. The surface processing apparatus 200 includes the image detection unit (CIS) 230. The image detection unit 230 detects an image on the to-be-processed medium outside of the end portion of the heating possible range of the heating unit 222 in the direction substantially orthogonal to the conveyance direction of the to-be-processed medium S and on the upstream side of the heating position of the heating unit 222 in the conveyance direction of the to-be-processed medium S. The surface processing apparatus 200 includes the first storage device (output image memory) 513 that stores the correction image information defining the correction image (correction pattern) Ap formed on the surface of the to-be-processed medium S, in which the positional relationship relative to the output image formed on the surface of the to-be-processed medium S is already known. The surface processing apparatus 200 includes the second storage device (glossy image memory) 514 that stores the processing area information defining the area of the surface of the to-be-processed medium S heated by the heating unit 222, in which the positional relationship relative to the output image formed on the surface of the to-be-processed medium S is already known. The surface processing apparatus 200 includes the control unit (CPU) 552 that uses the detection result of the correction image Ap by the image detection unit 230 and the correction image information to correct the heating position on the surface of the to-be-processed medium S by the heating unit 222 indicated by the processing area information.

In the present embodiment, the image detection unit 230 detects the position of the correction image Ap in the direction substantially orthogonal to the conveyance direction of the to-be-processed medium S. In the present embodiment, the image detection unit 230 is designed to detect the image on the to-be-processed medium at both end portions of the heating possible range of the heating unit 222 in the direction substantially orthogonal to the conveyance direction of the to-be-processed medium S. In the present embodiment, the control unit 552 performs the correction in accordance with the calculated magnitude in the direction substantially orthogonal to the conveyance direction of the to-be-processed medium S of the output image formed on the surface of the to-be-processed medium S. The magnitude is calculated from the distance between the correction images formed at both end portions indicated by the correction image information and the distance between the correction images at both end portions detected by the image detection unit 230. In the present embodiment, the control unit 552 performs the correction in accordance with the calculated tilt relative to the conveyance direction of the to-be-processed medium S of the output image formed on the surface of the to-be-processed medium S. The tilt is calculated from the relationship of the distances between the correction images formed at both end portions indicated by the correction image information and the leading edge of the to-be-processed medium S and from the relationship of the distances between the correction images at both end portions detected by the image detection unit and the leading edge of the to-be-processed medium S.

The image forming system 300 includes the surface processing apparatus 200 and the image forming apparatus 100 that forms, on the recording material P, the output image corresponding to the output image information and the correction image corresponding to the correction image information to supply the recording material P to the surface processing apparatus 200 as the to-be-processed medium S. Particularly, in the present embodiment, the image forming apparatus 100 can form the images in a range wider than the heating possible range in the direction substantially orthogonal to the conveyance direction of the to-be-processed medium S of the heating unit 222 of the surface processing apparatus 200. The image forming apparatus 100 forms the correction image at the same time as the formation of the output image.

According to the present embodiment, the position of the once output image on the to-be-processed medium S is calculated from the position of the correction pattern Ap on the to-be-processed medium S, and the heating control of the thermal head 222 is corrected. As a result, the heating control of the thermal head 222 allows the apparatus that partially applies the glossy processing to the once output image to high accurately match the positions of the image and the glossy processing. In this way, according to the present embodiment, the positions of the image formed on the to-be-processed medium S and the processing area can be accurately matched.

Second Embodiment

Another embodiment of the present invention will be described. Basic configurations and operations of the image forming system of the present embodiment are the same as those of the first embodiment. Therefore, elements with the same or equivalent functions and configurations as those of the first embodiment are designated with the same reference numerals, and the detailed descriptions will not be repeated.

In the present embodiment, reflective photo sensors are used to detect the correction pattern, instead of the detection by the first and second CISs 230*a* and 230*b* in the first embodiment. Although the reflective photo sensor can detect only one point, the reflective photo sensor is advantageous in terms of the cost and the space.

Figure 11:
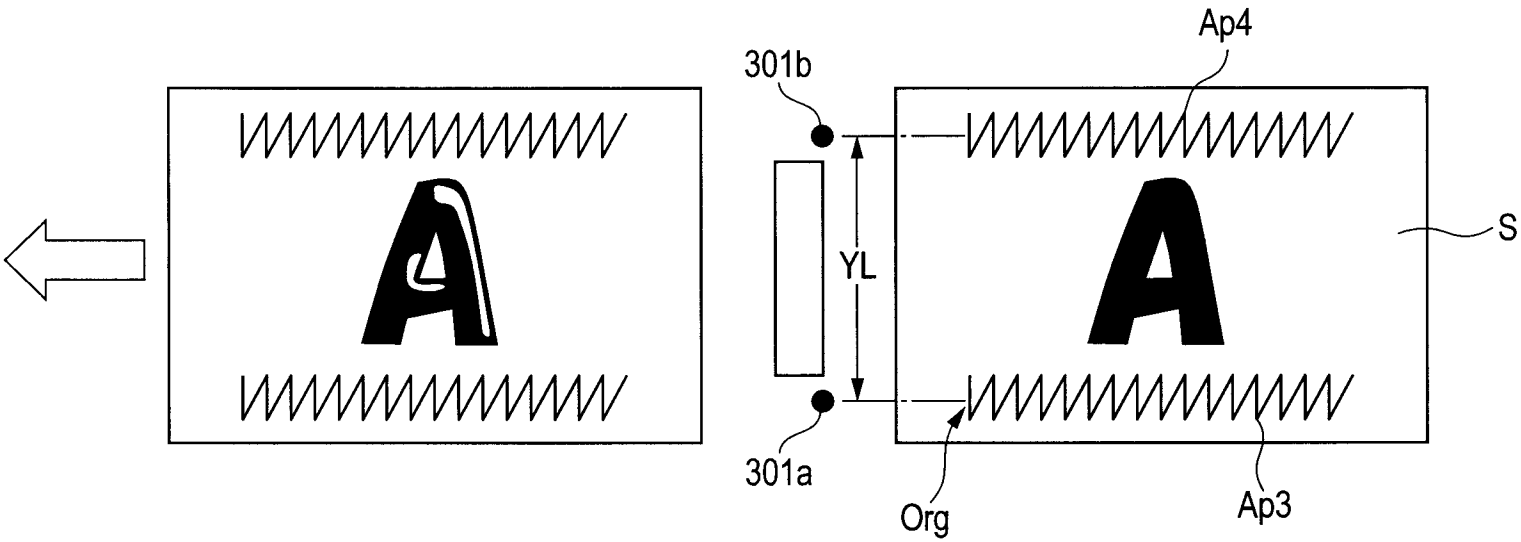
FIG. 11 is a schematic diagram viewing near the thermal head of the surface processing apparatus from above according to another embodiment.

FIG. 11 is a schematic diagram viewing near the thermal head 222 from above (vertical direction relative to the surface of the to-be-processed medium S conveyed to the processing part T) according to the present embodiment. In the present embodiment, first and second reflective photo sensors (hereinafter, called "photo sensors") 301*a* and 301*b* as image detection units are arranged at both end portions in the longitudinal direction of the thermal head 222 and on the upstream side of the thermal head 222 in the conveyance direction of the to-be-processed medium S. The focal positions of the first and second photo sensors 301*a* and 301*b* are at positions outside of the both end portions in the longitudinal direction of the thermal head 222 and at positions shifted by 7 mm from the heating position of the thermal head 222 toward the upstream side in the conveyance direction of the to-be-processed medium S. Through the first and second photo sensors 301*a* and 301*b*, the surface processing apparatus 200 can detect the leading edge of the to-be-processed medium S and the image formed on the to-be-processed medium S.

In the present embodiment, as in the first embodiment, the image forming apparatus 100 positions at least one element at the both end portions in the main scanning direction in the formation of the output image to write correction patterns Ap3 and Ap4 on the recording material P. Although the correction patterns Ap3 and Ap4 can be formed in an arbitrary color as long as the first and second photo sensors 301*a* and 301*b* can detect the patterns, the patterns are formed in black in the present embodiment. The first and second photo sensors 301*a* and 301*b* read the correction patterns Ap3 and Ap4. In this way, a minute positional displacement between the output image on the to-be-processed medium S and the output image data as a basis of the output image is detected, and the heating position of the thermal head 222 for obtaining a glossy image is corrected. In the present embodiment, detection signals of the first and second photo sensors 301*a* and 301*b* are input to the CPU 552 through an AD conversion part (not illustrated).

Figure 12:
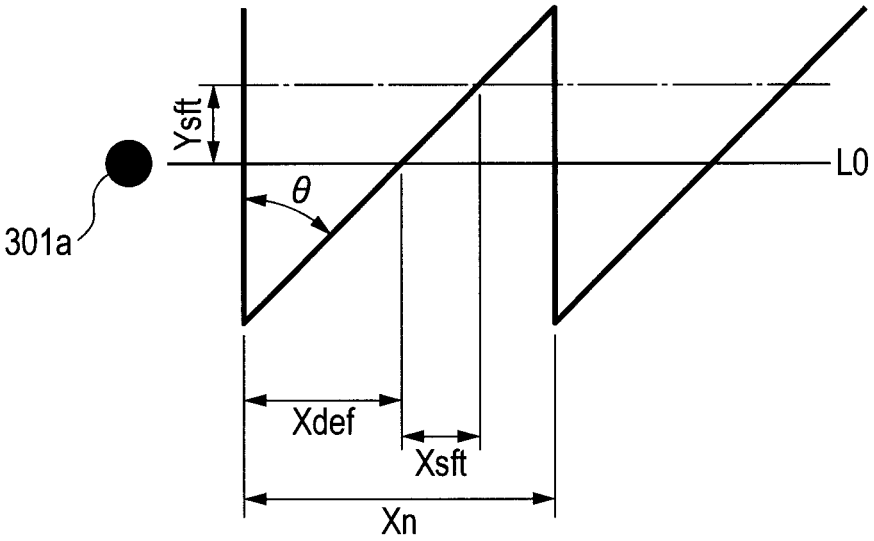
FIG. 12 is an enlarged view of a correction pattern according to the other embodiment.

FIG. 12 is an enlarged view of the correction pattern Ap3 at one of the end portions in the main scanning direction. In the present embodiment, the correction pattern Ap4 at the other end portion in the main scanning direction has the same configuration. The correction patterns Ap3 and Ap4 are saw-shaped. More specifically, the correction patterns Ap3 and Ap4 alternately include orthogonal lines in the main scanning direction (substantially right-angle direction relative to the conveyance direction of the recording material P) and oblique lines tilted relative to the orthogonal lines. One end portion of the oblique line is connected to one end portion in the main scanning direction of the orthogonal line, and the other end portion of the oblique line is connected to the other end portion in the main scanning direction of the next orthogonal line in the sub scanning direction. In the present embodiment, intervals Xn of the orthogonal lines are ⅕ inch (about 5 mm), and the angles θ formed by the orthogonal lines and the oblique lines are 45 degrees.

The following correction is performed for the position and the magnitude of the output image in the main scanning direction. An example of the first photo sensor 301*a* will be described. Assuming that a detection position (focal position) L0 of the first photo sensor 301*a* is on a reference line in the main scanning direction, and the distance between the orthogonal line and the oblique line is Xdef if there is no displacement of the position in the main scanning direction. Since the conveyance speed of the to-be-processed medium S is determined, the distance between the orthogonal line and the oblique line can be calculated from the times that the orthogonal line and the oblique line have passed through the position detected by the first photo sensor 301*a*. If there is a displacement Ysft in the main scanning direction, the distance between the orthogonal line and the oblique line is Xdef+Xsft. In the present embodiment, the angle θ of the oblique line is degrees, and Ysft=Xsft (Xsft=tan θ×Ysft). Therefore, known Xdef can be subtracted from the times that the orthogonal line and the oblique line have passed through the position detected by the first photo sensor 301*a* to calculate the displacement amount Ysft in the main scanning direction. The interval between the first photo sensor 301*a* and the second photo sensor 301*b* in the main scanning direction is fixed. Therefore, as in the first embodiment, the magnitude of the output image in the main scanning direction can be calculated from the calculated displacement amount. The position in the main scanning direction can also be calculated from the calculated displacement amount. As in the first embodiment, the glossy image data is corrected according to the calculated magnitude and position of the output image in the main scanning direction, and the heating position of the thermal head 222 is controlled.

Meanwhile, the following correction is performed for the position of the output image in the conveyance direction of the to-be-processed medium S. Just like the first embodiment in which the heating timing is corrected every time the correction pattern Ap1 is detected, the heating timing of the thermal head 222 is corrected based on the glossy image data after the correction of the magnitude in the main scanning direction every time the first photo sensor 301*a* detects the orthogonal line. In the present embodiment, the interval between the orthogonal lines is about 5 mm, and the heating timing of the thermal head 222 is controlled based on the glossy image data during the interval. In this case, even if the output image on the to-be-processed medium S is changed by 1% relative to the original output image data, the error can be suppressed to 50 μm.

The following correction is performed for the tilt of the output image. The difference between the distances from the leading edge positions of the to-be-processed medium S detected by the first and second photo sensors 301*a* and 301*b* to the position of the first orthogonal line is calculated from the difference between the detection timings of the orthogonal lines. In this way, the tilt of the output image conveyed to the processing part T can be calculated in the same way as in the first embodiment. The glossy image data is corrected in accordance with the calculated tilt as in the first embodiment, and the heating position of the thermal head 222 is controlled based on the result.

The intervals of the orthogonal lines and the angles of the oblique lines are not limited to the values in the present embodiment, and the values can be determined in accordance with the detection resolution of the used photo sensors.

Other Embodiments

Although the present invention has been described with reference to the specific embodiments, the present invention is not limited to the embodiments.

In the embodiments, the electrophotographic image forming apparatus uses, as a to-be-processed medium, a recording material having an image formed in four-color processes using four colored toners of yellow, magenta, cyan, and black. However, the present invention is not limited to this.

For example, the electrophotographic image forming apparatus may use, as a to-be-processed medium, a recording material having an image formed in five-color processes using the four colored toners and a resin-based transparent toner that does not contain color materials. In this case, for example, an image forming part for a transparent image with a similar configuration as the image forming parts 90Y, 90M, 90C, and 90Bk of the image forming apparatus 100 of FIG. 1 is arranged on the uppermost stream in the moving direction of the image transfer surface of the intermediate transferring member 40. An example of the transparent toner includes a toner that does not include a pigment and that is mainly made of a polyester resin. Particles with high light transmission that are made of a resin which does not substantially contain a colorant can be suitably used as the transparent toner. The particles are substantially colorless, and at least visible light can be excellently transmitted without substantial scattering. However, a transparent toner that becomes substantially colorless and transparent after the fixation can be suitably used, and the transparent toner may not be colorless and transparent before the fixation. For example, the transparent toner may look white when gathered. For example, the transparent toner can supplement a section with a low coverage rate after the separation into yellow, magenta, cyan, and black, and the print pattern can be determined and output so that the entire recording material is covered by the toners. This allows surface processing of an arbitrary location of the to-be-processed medium. Alternatively, a certain amount of the transparent toner may be applied to the entire surface of the recording material.

The process is not limited to the four-color and five-color processes. For example, a recording material applied with resin coating and having an image formed by a four-color process may be used as the to-be-processed medium.

Alternatively, for example, a recording material recorded by melting thermal transfer recording, sublimation thermal transfer recording, or inkjet recording can be similarly used as the to-be-processed recording. In this case, the surface of the recording material can be covered by a thermoplastic resin to apply surface processing to an arbitrary location of the entire surface of the to-be-processed medium.

The example of arranging the sensors on both sides in the longitudinal direction of the thermal head has been described in the embodiments. However, the displacement relative to the image data is generally large in the conveyance direction. Therefore, the sensor may be arranged only on one side to correct the position of the glossy image only in the sub scanning direction.

The case of obtaining a glossy image on an image once output to control the surface property of the surface of the to-be-processed medium has been described in the embodiments. Meanwhile, features of a printer matter may need to express a metallic property such as gold and silver. In an electrophotographic apparatus that uses electrostatic force to form an image, it is fundamentally difficult to use a metallic material for a toner that is a base material for forming an image. In a thermal transfer printer (thermal transfer system) using a thermal head, for example, a metallic deposited layer as a metallic color ink can be formed on a film, and the layer can be transferred by heat to form an image with a metallic property (Japanese Patent Application Laid-Open No. 2001-130150). The film used in the thermal transfer system includes a film base material and an ink layer coated over the film base material. The ink layer is coated over the film base material through a release layer in some cases, and an adhesive layer is provided over the ink layer in some cases. The positioning of the printed matter and the features is important not only in the cases of gold and silver, but also in the case of forming the features on the printed matter in post-processing. The present invention can also be applied to a case in which a metallic color ink of gold or silver is deposited on the film, and the film is heated by the thermal head to thermally transfer an image with the features to the once output image. In this case, the image with the features and the output image can be excellently positioned as in the case of positioning of the glossy image and the output image in the embodiments. In the present embodiment, the partial thermal transfer of the metallic color ink to the surface of the to-be-processed medium to provide metallic expression such as metallic gloss is also included in the surface processing of the to-be-processed medium. More specifically, the surface of the film can have a surface roughness different from the surface roughness of the thermoplastic resin image surface on the to-be-processed medium, or an ink melted and transferred to the to-be-processed medium by heat can be coated over the film. In this way, the present invention can be applied to a surface processing apparatus and an image forming system including the surface processing apparatus that partially controls the surface property of the surface of a to-be-processed medium by heating through a film and that partially and thermally transfers a thermofusible ink on the film to the surface of the to-be-processed medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-097684, filed Apr. 25, 2011, which is hereby incorporated by reference herein in its entirety.

What is claimed is:

1. A processing apparatus that processes a sheet output from an image forming apparatus including an image forming device that forms an image on a sheet and a heating device that heats the sheet on which the image is formed, the processing apparatus comprising:

a conveyance device that conveys the sheet;

a partial heating device that heats one or more parts of the sheet selectively;

a position acquisition device that acquires a heat position at which said partial heating device heats the sheet;

a detection device that detects the image on the sheet heated by the heating device, on an upstream side of said partial heating device;

a distance acquisition device that acquires distance information in the image that is obtained before the heating device heats the sheet, the image being formed on the sheet by the image forming device; and a controller that corrects the heat position at which said partial heating device heats the sheet, acquired by said position acquisition device, based on a detection result of said detection device and said distance information acquired by the distance acquisition device.

2. A processing apparatus according to claim 1, wherein images output to the sheet include an output image and a correction image formed in a direction orthogonal to a sheet conveyance direction and formed outside of a width of the output image, and said controller corrects the heat position acquired by said position acquisition device at a magnification calculated from a distance in the correction image acquired by said distance acquisition device before the heating device heats the correction image, and at a magnification calculated from a result of detecting the correction image acquired by said detection device after the heating device heats the sheet.

3. A processing apparatus according to claim 2, wherein the correction image includes a plurality of marks arranged at equal intervals in the sheet conveyance direction, and said distance acquisition device acquires a distance between the marks formed on the sheet by the image forming device before heating by the heating device.

4. A processing apparatus according to claim 3, wherein an interval between the marks adjacent in the sheet conveyance direction is an integral multiple of a resolution of said partial heating device in the sheet conveyance direction.

5. A processing apparatus according to claim 1, wherein said controller calculates a tilt with regard to the sheet conveyance direction of the sheet based on the image on the sheet detected by said detection device and corrects the heating position acquired by said position acquisition device based on the tilt calculated by said controller.

6. A processing apparatus according to claim 1, wherein the processing apparatus includes a film that contacts the sheet conveyed by said conveyance device, and said partial heating device heats the sheet through said film.

7. An image forming system comprising:

the image forming device that forms an image on a sheet;

the heating device that heats the sheet having the image formed by the image forming device; and the processing apparatus according to claim 1.

* * * * *